US008451304B2

(12) United States Patent
Taki et al.

(10) Patent No.: US 8,451,304 B2
(45) Date of Patent: May 28, 2013

(54) RECORDING MEDIUM SORTING APPARATUS, ERASING APPARATUS, AND RECORDING MEDIUM SORTING METHOD

(75) Inventors: Hiroyuki Taki, Shizuoka (JP); Isao Yahata, Shizuoka (JP); Takahiro Kawaguchi, Shizuoka (JP); Hiroyuki Taguchi, Shizuoka (JP); Hiroyuki Tsuchihashi, Shizuoka (JP); Ken Iguchi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 290 days.

(21) Appl. No.: 13/027,206

(22) Filed: Feb. 14, 2011

(65) Prior Publication Data

US 2011/0221848 A1 Sep. 15, 2011

Related U.S. Application Data

(60) Provisional application No. 61/314,098, filed on Mar. 15, 2010.

(51) Int. Cl.
*B41J 2/32* (2006.01)
*B65H 7/02* (2006.01)

(52) U.S. Cl.
USPC ..... 347/177; 347/179; 347/218

(58) Field of Classification Search
USPC ..... 347/101, 104, 218, 262, 264, 177, 347/179
See application file for complete search history.

(56) References Cited

U.S. PATENT DOCUMENTS

| | | | | |
|---|---|---|---|---|
| 8,109,502 | B2 * | 2/2012 | Mizuyama | 271/126 |
| 8,292,287 | B2 * | 10/2012 | Iguchi et al. | 271/9.08 |
| 2010/0321457 | A1 | 12/2010 | Kawaguchi | |
| 2011/0033216 | A1 | 2/2011 | Taki | |
| 2011/0242257 | A1 * | 10/2011 | Takami et al. | 347/218 |
| 2012/0149562 | A1 * | 6/2012 | Iguchi et al. | 503/201 |
| 2013/0002784 | A1 * | 1/2013 | Iguchi et al. | 347/179 |
| 2013/0003138 | A1 * | 1/2013 | Sugizaki et al. | 358/461 |

* cited by examiner

*Primary Examiner* — Huan Tran
(74) *Attorney, Agent, or Firm* — Patterson & Sheridan, LLP

(57) ABSTRACT

According to one embodiment, an erasing apparatus includes: a recording medium sorting apparatus including a first conveyance guide having a curvature radius smaller than curvature radiuses of all curved surfaces present in a downstream direction in a recording medium conveying path, a second conveyance guide forming the recording medium conveying path in conjunction with the first conveyance guide and set to be capable of opening and closing the recording medium conveying path, and a displacing device configured to open and close the second conveyance guide; and a control unit. If the control unit determines that a jam occurs in the recording medium sorting apparatus, the control unit opens the second conveyance guide to collect a recording medium that causes the jam.

20 Claims, 5 Drawing Sheets

RECORDING MEDIUM SORTING APPARATUS, ERASING APPARATUS, AND RECORDING MEDIUM SORTING METHOD

CROSS-REFERENCE TO RELATED APPLICATIONS

This application is based upon and claims the benefit of priority from the prior the U.S. Patent Application No. 61/314,098, filed on Mar. 15, 2010, and the entire contents of which are incorporated herein by reference.

FIELD

Embodiments described herein relate generally to a recording medium sorting apparatus, an erasing apparatus, and a recording medium sorting method.

BACKGROUND

For saving of resources, in some case, image formation is performed using erasable developing materials. As the erasable developing materials, there are toner, ink, and the like erased by heat. Recording media on which images are formed with such erasable developing materials are reused after being heated by an erasing apparatus to have the images erased from the recording media.

However, in some case, plural used recording media inserted into the erasing apparatus are bound by a clip or a stapler. When the plural bound recording media are conveyed, the recording media cause a jam halfway in a recording medium conveying mechanism and cause a failure of the erasing apparatus.

Concerning this problem, a technique for detecting double feed with a double-feed detection sensor is proposed. However, in some case, double feed cannot be detected by the double-feed detection sensor. Therefore, there is a demand for a recording medium sorting apparatus, an erasing apparatus, and a recording medium sorting method that efficiently sort recording media that are likely to cause a jam.

DETAILED DESCRIPTION

Throughout this description, the embodiments and examples shown should be considered as exemplars, rather than limitations on the apparatus and methods of the present embodiments.

Exemplary embodiments of the present invention are explained in detail below with reference to the accompanying drawings.

In general, according to one embodiment, an erasing apparatus includes: a recording medium conveying mechanism configured to convey a recording medium; a heating roller configured to heat the recording medium to temperature equal to or higher than erasing temperature; a first conveyance guide forming a recording medium conveying path having curved surfaces; a second conveyance guide arranged to be opposed to and spaced apart from the first conveyance guide and configured to convey the recording medium through a space between the first conveyance guide and the second conveyance guide; a displacing device configured to displace the second conveyance guide and open and close the recording medium conveying path; a jam sensor configured to detect that the recording medium conveyed through the space between the first conveyance guide and the second conveyance guide causes a jam; and a control unit configured to cause, if the jam sensor determines that a jam occurs, the displacing device to displace the second conveyance guide and open the recording medium conveying path.

First Embodiment

Figure 1:
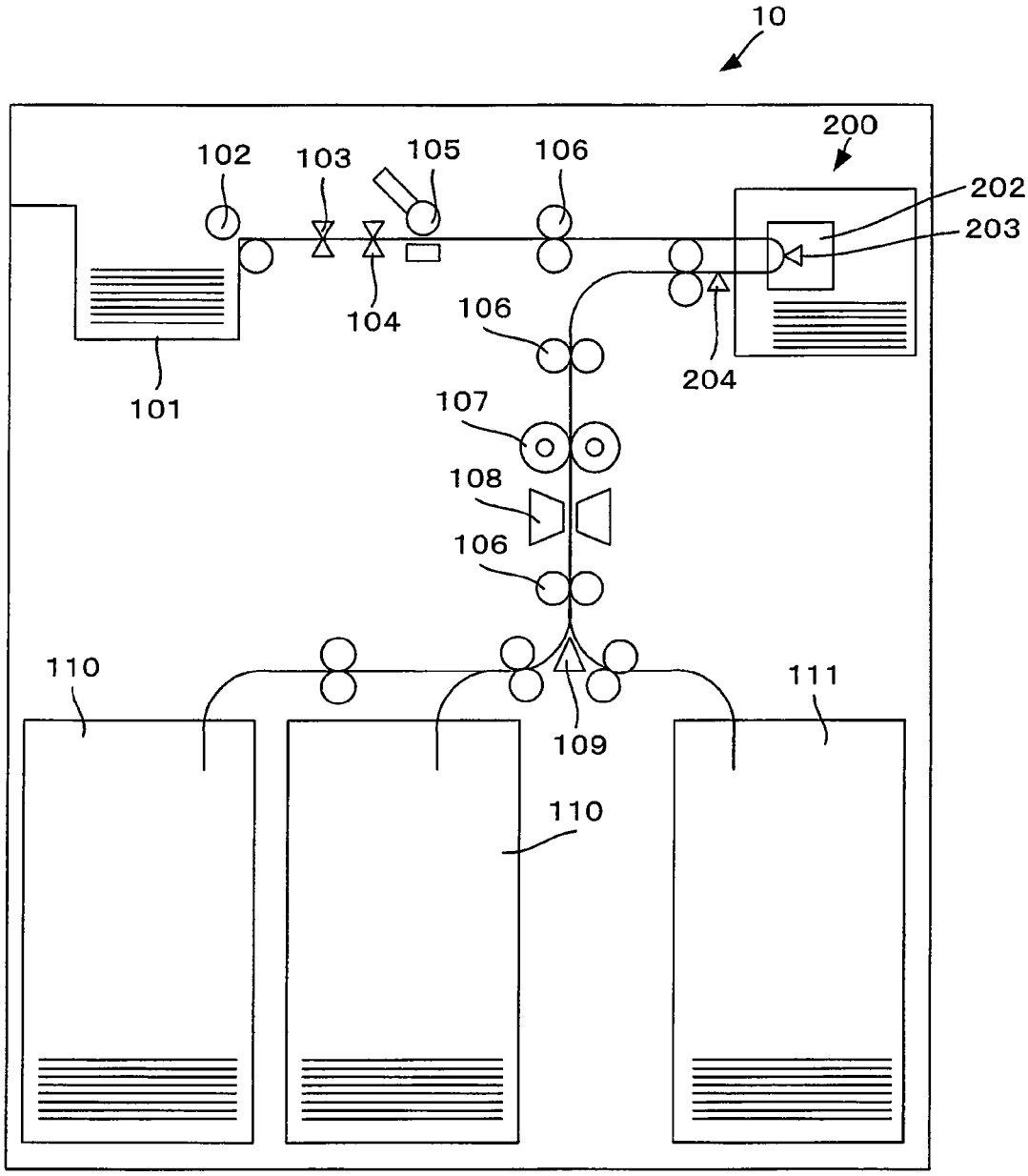
FIG. 1 is a side view of an erasing apparatus including a recording medium sorting apparatus according to a first embodiment.

FIG. 1 is a side view of an erasing apparatus 10 including a recording medium sorting apparatus according to a first embodiment. As shown in FIG. 1, the erasing apparatus 10 includes an inlet tray 101 on which recording media to be subjected to erasing are placed, a pickup roller 102 configured to pick up the recording media placed on the inlet tray 101 one by one, a passage sensor 103 configured to detect passage of the recording medium, a double feed sensor 104 configured to detect double feed of the recording media, a thickness sensor 105 configured to detect the thickness of the recording medium, conveying rollers 106 configured to convey the recording medium, a recording medium sorting apparatus 200 configured to identify and sort the recording medium, a heating roller 107, as the heating device, configured to heat the recording medium to temperature equal to or higher than erasing temperature, an image detection sensor 108 configured to detect whether an image on the recording medium is erased, a switching device 109 configured to switch a conveying path for the recording, medium, reuse boxes 110 in which reusable recording media are accumulated, a disposal box 111 in which unreusable recording media are accumulated, and a control unit.

The double feed sensor 104 causes, for example, ultrasound to pass from one surface to the other surface of the recording medium and outputs a level of the ultrasound passed through the recording medium. The control unit determines double feed on the basis of the level.

The thickness sensor 105 brings an actuator into contact with the recording medium, transmits the movement of the actuator to a permanent magnet, detects the movement of the permanent magnet with a magnetic sensor, and outputs a signal corresponding to the thickness of the recording medium. The control unit determines the thickness of the recording medium on the basis of the output signal.

The heating roller 107, as the heating device, is formed of metal and includes a heater on the inside thereof. The heating roller 107 heats an erasable developing material on the recording medium to temperature equal to or higher than the erasing temperature and subjects the recording medium to erasing.

Any heat source may be used for the heating devices as long as the devices can heat the recording media to the color erasing temperature or higher. For the heating devices, for example, thermal heads, halogen heaters, graphite heaters, IH (Induction Heater), rollers formed by heat conducting materials with heat generating lamps inside, or the like may be employed.

Any heat source which heats the recording media without contacting also may be employed for the heating device.

Examples of the erasable developing material include a color-assuming compound, a developer, and a decolorizer. Examples of the color-assuming compound include a leuco dye. Examples of the developer include phenol. Examples of the decolorizer include a substance that, when heated, dissolves with the color-assuming compound and does not have affinity with the developer.

The erasable developing material develops a color according to a mutual action of the color-assuming compound and the developer. Since the mutual action of the color-assuming compound and the developer is interrupted by heating to temperature equal to or higher than the erasing temperature, the developing material is erased.

As the image detection sensor 108, an optical image sensor such as a line sensor or a CMOS sensor can be used. An output of the image detection sensor 108 is converted into digital data by an A/D converter and output to the control unit.

The control unit determines, on the basis of the digital data, whether an un-erased image is present on the recording medium.

The recording medium is determined as unreusable if an un-erased image is present on the recording medium. The recording medium is conveyed through a recording medium conveying path switched by the switching device 109 and accumulated in the disposal box 111.

The recording medium sorting apparatus 200 includes a second conveyance guide 202, a first jam sensor 203 set in the recording medium conveying path of the recording medium sorting apparatus 200 and configured to detect presence or absence of the recording medium, and a second jam sensor 204 set downstream in a recording medium conveying direction of the second conveyance guide 202 and configured to detect presence or absence of the recording medium.

The recording medium sorting apparatus 200 is set upstream in the recording medium conveying direction of the heating roller 107.

Figure 2:
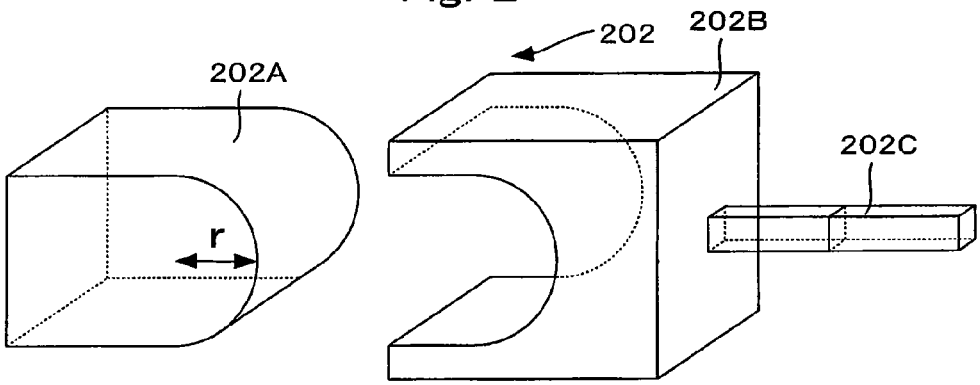
FIG. 2 is a perspective view of the structure of the recording medium sorting apparatus according to the first embodiment.

FIG. 2 is a perspective view of the structure of the recording medium sorting apparatus 200 according to the first embodiment. As shown in FIG. 2, the recording medium sorting apparatus 200 includes a first conveyance guide 202A formed in a convex shape and forming one surface of the recording medium conveying path, a second conveyance guide 202B arranged to be opposed to the first conveyance guide 202A to cover the outer side of the first conveyance guide 202A and forming the other surface of the recording medium conveying path, and a displacing device 202C configured to cause the second conveyance guide 202B to reciprocatingly move in the direction of the first conveyance guide 202A.

The recording medium is conveyed through a space between the first conveyance guide 202A and the second conveyance guide 202B.

The recording medium sorting apparatus 200 includes the first conveyance guide 202A having a curvature radius r smaller than curvature radiuses of all curved surfaces present in a downstream direction in the recording medium conveying path of the recording medium sorting apparatus 200, the second conveyance guide 202B forming the recording medium conveying path in conjunction with the first conveyance guide 202A and set to be capable of opening and closing the recording medium conveying path, and the displacing device 202C configured to open and close the second conveyance guide 202B.

The recording medium conveying path of the recording medium sorting apparatus 200 forms a curved surface along a convex portion of the first conveyance guide 202A. Specifically, the recording medium conveying path of the recording medium sorting apparatus 200 draws a curved surface having a curvature radius equal to the curvature radius r of the convex portion of the first conveyance guide 202A. The curvature radius r is smaller than the curvature radiuses of all the curved surfaces present in the downstream direction of the recording medium conveying path of the recording medium sorting apparatus 200.

The recording medium causes a jam in a section of the curved surface of the recording medium conveying path. A jam more easily occurs as the curvature radius of the curved surface is smaller. The curvature radius r of the curved surface of the recording medium conveying path of the recording medium sorting apparatus 200 is smaller than the curvature radiuses of all the curved surfaces present in the downstream direction of the recording medium conveying path of the recording medium sorting apparatus 200. Therefore, the recording medium that can pass the curved surface of the recording medium sorting apparatus 200 can pass the curved surfaces present further downstream than the recording medium sorting apparatus 200 without causing a jam.

Figure 3:
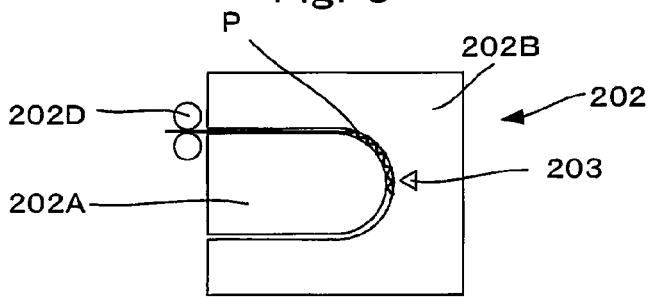
FIG. 3 is a diagram of a state in which a jam occurs in the recording medium sorting apparatus according to the first embodiment.

FIG. 3 is a diagram of a state in which a jam occurs in the recording medium sorting apparatus 200 according to the first embodiment. As shown in FIG. 3, an inserting roller 202D set in an inlet of the recording medium sorting apparatus 200 conveys a recording medium P into the recording medium sorting apparatus 200.

The first jam sensor 203 and the second jam sensor 204 detect presence or absence of the recording medium and output a signal to the control unit. If a state in which the first jam sensor 203 detects the recording medium and the second jam sensor 204 does not detect the recording medium continues for a time equal to or longer than a threshold time set in advance, the control unit determines that a jam occurs.

If the control unit determines that a jam occurs, the control unit stops driving of the inserting roller 202D.

Figure 4:
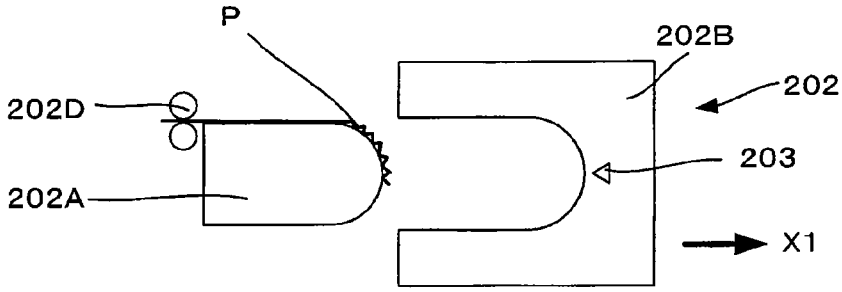
FIG. 4 is a diagram of a state in which a second conveyance guide according to the first embodiment is opened.

FIG. 4 is a diagram of a state in which the second conveyance guide 202B according to the first embodiment is opened. As shown in FIG. 4, if the control unit determines that a jam occurs in the recording medium sorting apparatus 200, the control unit drives a solenoid of the displacing device 202C to displace the second conveyance guide 202B in a direction opposite to the first conveyance guide 202A, i.e., an arrow X1 direction and open the recording medium conveying path.

Figure 5:
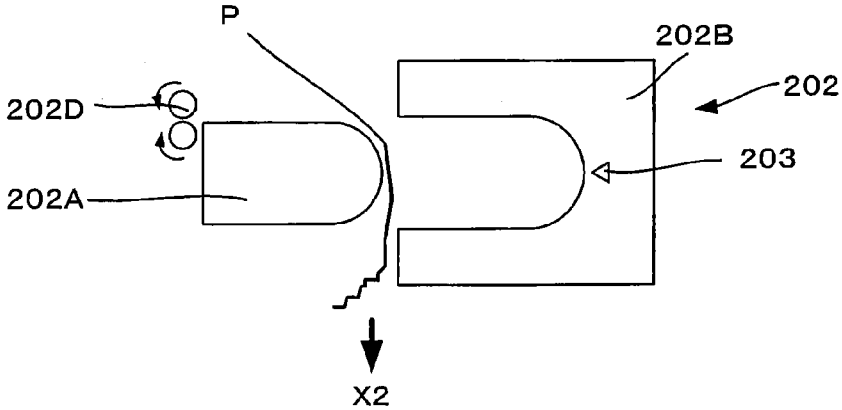
FIG. 5 is a diagram for explaining an operation for collecting a recording medium that causes a jam in the first embodiment.

FIG. 5 is a diagram of an operation for collecting a recording medium that causes a jam in the first embodiment. As shown in FIG. 5, the control unit drives the inserting roller 202D to drop the recording medium, which causes the jam, in an arrow X2 direction into a collection box below the recording medium sorting apparatus 200.

If the first jam sensor 203 does not detect the recording medium, the control unit drives the solenoid of the displacing device 202C to displace the second conveyance guide 202B in a direction opposite to the arrow X1 direction and close the recording medium conveying path.

If the first jam sensor 203 still detects the recording medium even if the inserting roller 202D is driven for a fixed time, the control unit determines that a failure occurs and displays to that effect on a control panel 402.

Figure 6:
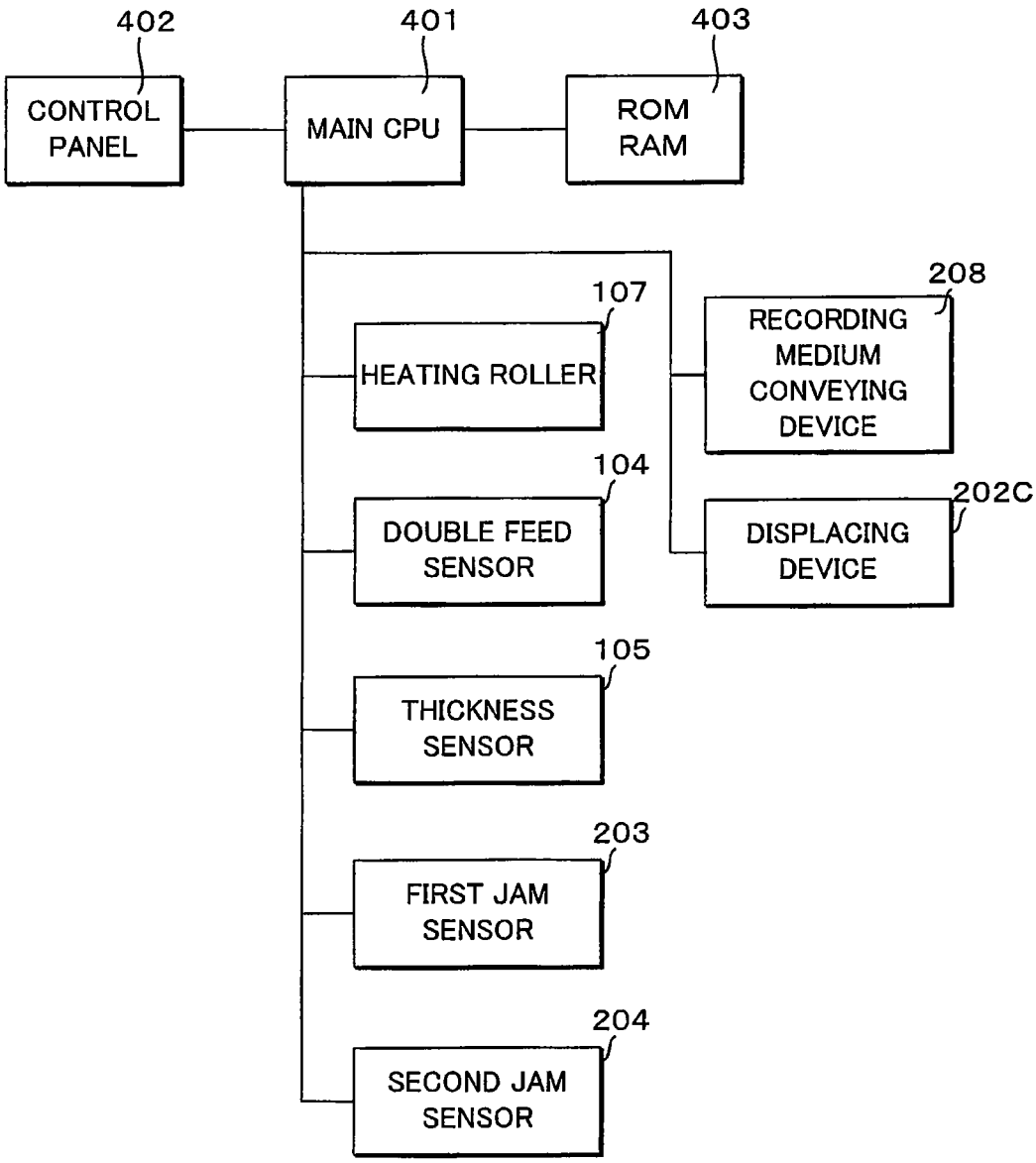
FIG. 6 is a diagram of the configuration of the erasing apparatus according to the first embodiment.

FIG. 6 is a diagram of the configuration of the erasing apparatus 10 according to the first embodiment. As shown in FIG. 6, the erasing apparatus 10 includes a main CPU 401 serving as the control unit, the control panel 402 serving as a display device, and a ROM and RAM 403 serving as a storage device.

The main CPU 401 is connected to the heating roller 107, the double feed sensor 104, the thickness sensor 105, the first jam sensor 203, the second jam sensor 204, a recording medium conveying device 208 configured to convey the recording medium, and the displacing device 202C.

As explained above, the erasing apparatus 10 according to this embodiment includes the recording medium sorting apparatus 200 including the first conveyance guide 202A having the curvature radius r smaller than the curvature radiuses of all the curved surfaces present in the downstream direction of the recording medium conveying path, the second conveyance guide 202B forming the recording medium conveying path in conjunction with the first conveyance guide 202A and set to be capable of opening and closing the recording medium conveying path, and the displacing device 202C configured to open and close the second conveyance guide 202B and the control unit. If the control unit determines that a jam occurs in the recording medium sorting apparatus 200, the control unit opens the second conveyance guide 202B and collects the recording medium that causes the jam.

Therefore, there is an effect that it is possible to efficiently sort a recording medium that is likely to cause a jam.

Second Embodiment

Figure 7:
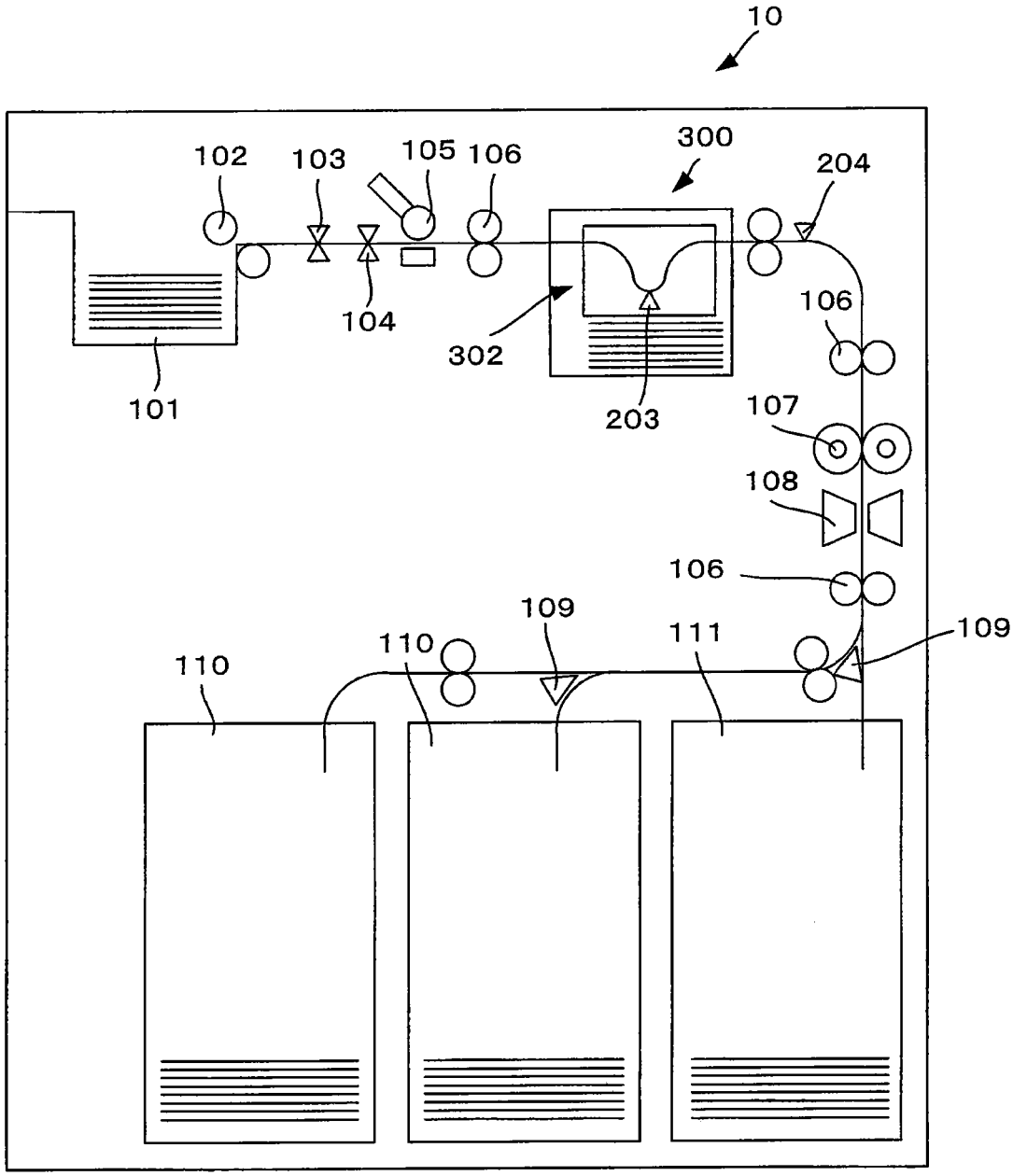
FIG. 7 is a side view of an erasing apparatus including a recording medium sorting apparatus according to a second embodiment.

FIG. 7 is a side view of the erasing apparatus 10 including a recording medium sorting apparatus according to a second embodiment. As shown in FIG. 7, the erasing apparatus 10 includes the inlet tray 101 on which recording media to be subjected to erasing are placed, the pickup roller 102 configured to pick up the recording media placed on the inlet tray 101 one by one, the passage sensor 103 configured to detect passage of the recording medium, the double feed sensor 104 configured to detect double feed of the recording media, the thickness sensor 105 configured to detect the thickness of the recording medium, the conveying rollers 106 configured to convey the recording medium, a recording medium sorting apparatus 300 configured to identify and sort the recording medium, the heating roller 107 configured to heat the recording medium to temperature equal to or higher than erasing temperature, the image detection sensor 108 configured to detect whether an image on the recording medium is erased, the switching devices 109 configured to switch a conveying path for the recording medium, the reuse boxes 110 in which reusable recording media are accumulated, the disposal box 111 in which unreusable recording media are accumulated, and a control unit.

The configurations and the operations of the double feed sensor 104, the thickness sensor 105, the heating roller 107, and the image detection sensor 108 are the same as the configurations and the operations of the double feed sensor 104, the thickness sensor 105, the heating roller 107, and the image detection sensor 108 in the first embodiment.

The recording medium sorting apparatus 300 includes a second conveyance guide 302, the first jam sensor 203 set in a recording medium conveying path of the recording medium sorting apparatus 300, and the second jam sensor 204 set downstream in the recording medium conveying direction of the second conveyance guide 302.

The recording medium sorting apparatus 300 is set upstream in the recording medium conveying direction of the heating roller 107.

Figure 8:
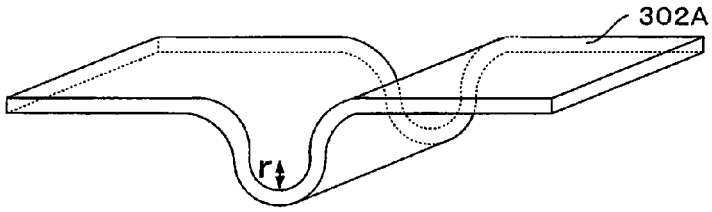
FIG. 8 is a perspective view of the structure of a first conveyance guide according to the second embodiment.

FIG. 8 is a perspective view of the structure of a first conveyance guide 302A according to the second embodiment. As shown in FIG. 8, the recording medium sorting apparatus 300 includes the first conveyance guide 302A formed in a convex shape and forming one surface of the recording medium conveying path.

Figure 9:
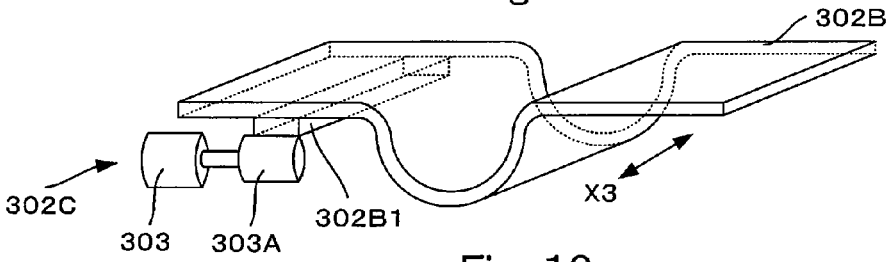
FIG. 9 is a perspective view of the structure of a second conveyance guide according to the second embodiment.

FIG. 9 is a perspective view of the structure of a second conveyance guide 302B according to the second embodiment. As shown in FIG. 9, the recording medium sorting apparatus 300 includes the second conveyance guide 302B arranged to be opposed to the first conveyance guide 302A to cover the outer side of the first conveyance guide 302A and forming the other surface of the recording medium conveying path and a displacing device 302C configured to cause the second conveyance guide 302B to reciprocatingly move in a direction perpendicular to the recording medium conveying direction, i.e., an arrow X3 direction.

The recording medium is conveyed through a space between the first conveyance guide 302A and the second conveyance guide 302B.

The displacing device 302C includes a motor 303, a gear 303A connected to the motor 303, and a plate 302B1 having teeth that mesh with the gear 303A and set on the second conveyance guide 302B.

The displacing device 302C regularly or reversely rotates to thereby open or close the second conveyance guide 302B.

Figure 10:
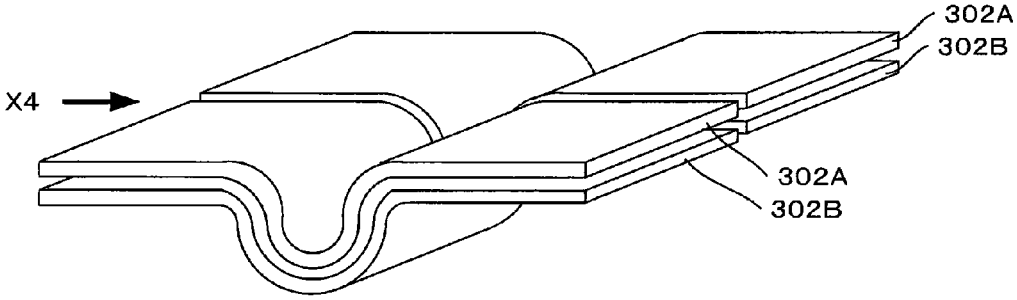
FIG. 10 is a perspective view of the structure of the recording medium sorting apparatus according to the second embodiment.

FIG. 10 is a perspective view of the structure of the recording medium sorting apparatus 300 according to the second embodiment. As shown in FIG. 10, the recording medium sorting apparatus 300 includes two sets of the first conveyance guides 302A and the second conveyance guides 302B. The recording medium is conveyed in a direction of an arrow X4 through a conveying path formed by the first conveyance guides 302A and the second conveyance guides 302B.

Figure 11:
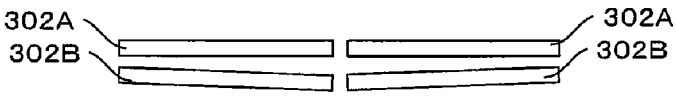
FIG. 11 is an X4 arrow view of the recording medium sorting apparatus according to the second embodiment.

FIG. 11 is an X4 arrow view of the recording medium sorting apparatus 300 according to the second embodiment. As shown in FIG. 11, the second conveyance guides 302B tilt downward to the inner side of the recording medium conveying path.

Therefore, when the second conveyance guides 302B are opened, a recording medium that causes a jam can be efficiently dropped.

The recording medium sorting apparatus 300 includes the first conveyance guides 302A having the curvature radius r smaller than curvature radiuses of all curved surfaces present in a downstream direction in the recording medium conveying path of the recording medium sorting apparatus 300, the second conveyance guides 302B forming the recording medium conveying path in conjunction with the first conveyance guides 302A and set to be capable of opening and closing the recording medium conveying path, and the displacing device 302C configured to open and close the second conveyance guides 302B.

The recording medium conveying path of the recording medium sorting apparatus 300 forms a curved surface along convex portions of the first conveyance guides 302A. Specifically, the recording medium conveying path of the recording medium sorting apparatus 300 draws a curved surface having a curvature radius equal to the curvature radius r of the convex portions of the first conveyance guides 302A. The curvature radius r is smaller than the curvature radiuses of all the curved surfaces present in the downstream direction of the recording medium conveying path of the recording medium sorting apparatus 300.

The recording medium causes a jam in a section of the curved surface of the recording medium conveying path. A jam more easily occurs as the curvature radius of the curved surface is smaller. The curvature radius r of the curved surface of the recording medium conveying path of the recording medium sorting apparatus 300 is smaller than the curvature radiuses of all the curved surfaces present in the downstream direction of the recording medium conveying path of the recording medium sorting apparatus 300. Therefore, the recording medium that can pass the curved surface of the recording medium sorting apparatus 300 can pass the curved surfaces present further downstream than the recording medium sorting apparatus 300 without causing a jam.

Occurrence of a jam in the recording medium sorting apparatus 300 is explained below. An inserting roller set in an inlet of the recording medium sorting apparatus 300 conveys the recording medium P into the recording medium sorting apparatus 300.

The first jam sensor 203 and the second jam sensor 204 detect presence or absence of the recording medium and output a signal to the control unit. If a state in which the first jam sensor 203 detects the recording medium and the second jam sensor 204 does not detect the recording medium continues for a time equal to or longer than a threshold time set in advance, the control unit determines that a jam occurs.

If the control unit determines that a jam occurs, the control unit stops driving of the inserting roller. If the control unit determines that a jam occurs in the recording medium sorting apparatus 300, the control unit drives the motor 303 of the displacing device 302C to displace the second conveyance guides 302B to the outer side in a direction perpendicular to the recording medium conveying direction and open the recording medium conveying path.

The control unit drives the inserting roller to drop the recording medium, which causes the jam, into a collection box below the recording medium sorting apparatus 300.

If the first jam sensor 203 does not detect the recording medium, the control unit drives the motor 303 of the displacing device 302C to displace the second conveyance guides 302B to the inner side in the direction perpendicular to the recording medium conveying direction and close the recording medium conveying path.

If the first jam sensor 203 still detects the recording medium even if the inserting roller is driven for a fixed time, the control unit determines that a failure occurs and displays to that effect on the control panel 402.

The configuration of the erasing apparatus 10 is the same as the configuration of the erasing apparatus 10 according to the first embodiment shown in FIG. 6.

As explained above, the erasing apparatus 10 according to this embodiment includes the recording medium sorting apparatus 300 including the first conveyance guides 302A having the curvature radius r smaller than the curvature radiuses of all the curved surfaces present in the downstream direction in the recording medium conveying path, the second conveyance guides 302B forming the recording medium conveying path in conjunction with the first conveyance guides 302A and set to be capable of opening and closing the recording medium conveying path, and the displacing device 302C configured to open and close the second conveyance guides 302B and the control unit. If the control unit determines that a jam occurs in the recording medium sorting apparatus 300, the control unit opens the second conveyance guides 302B to the outer side in the direction perpendicular to the recording medium conveying direction and collects the recording medium that causes the jam.

Therefore, there is an effect that it is possible to reduce the size of the erasing apparatus 10 that can efficiently sort a recording medium that is likely to cause a jam.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A recording medium sorting apparatus comprising:

a first conveyance guide forming a recording medium conveying path having curved surfaces;

a second conveyance guide arranged to be opposed to and spaced apart from the first conveyance guide and configured to convey a recording medium through a space between the first conveyance guide and the second conveyance guide;

a displacing device configured to displace the second conveyance guide and open and close the recording medium conveying path;

a jam sensor configured to detect that the recording medium conveyed through the space between the first conveyance guide and the second conveyance guide causes a jam; and a control unit configured to cause, if the jam sensor determines that a jam occurs, the displacing device to displace the second conveyance guide and open the recording medium conveying path.

2. The apparatus according to claim 1, wherein the displacing device displaces the second conveyance guide in a direction opposite to the first conveyance guide to thereby open the recording medium conveying path.

3. The apparatus according to claim 1, wherein the displacing device displaces the second conveyance guide to an outer side in a direction perpendicular to a recording medium conveying direction to thereby open the recording medium conveying path.

4. The apparatus according to claim 3, further comprising a plurality of the second conveyance guides, wherein the second conveyance guides tilt downward to an inner side of the recording medium conveying path.

5. The apparatus according to claim 1, wherein the first conveyance guide and the second conveyance guide are set upstream in a recording medium conveying direction of a heating device included in an erasing apparatus.

6. An erasing apparatus comprising:

a recording medium conveying mechanism configured to convey a recording medium;

a heating device configured to heat the recording medium to temperature equal to or higher than erasing temperature;

a first conveyance guide forming a recording medium conveying path having curved surfaces;

a second conveyance guide arranged to be opposed to and spaced apart from the first conveyance guide and configured to convey the recording medium through a space between the first conveyance guide and the second conveyance guide;

a displacing device configured to displace the second conveyance guide and open and close the recording medium conveying path;

a jam sensor configured to detect that the recording medium conveyed through the space between the first conveyance guide and the second conveyance guide causes a jam; and a control unit configured to cause, if the jam sensor determines that a jam occurs, the displacing device to displace the second conveyance guide and open the recording medium conveying path.

7. The apparatus according to claim 6, wherein the displacing device displaces the second conveyance guide in a direction opposite to the first conveyance guide to thereby open the recording medium conveying path.

8. The apparatus according to claim 6, wherein the displacing device displaces the second conveyance guide to an outer side in a direction perpendicular to a recording medium conveying direction to thereby open the recording medium conveying path.

9. The apparatus according to claim 8, further comprising a plurality of the second conveyance guides, wherein the second conveyance guides tilt downward to an inner side of the recording medium conveying path.

10. The apparatus according to claim 6, wherein the first conveyance guide and the second conveyance guide are set upstream in a recording medium conveying direction of the heating device.

11. The apparatus according to claim 6, further comprising:

a first jam sensor provided in the recording medium conveying path formed by the first conveyance guide and the second conveyance guide and configured to detect presence or absence of the recording medium; and a second jam sensor provided downstream in a recording medium conveying direction of the recording medium conveying path formed by the first conveyance guide and the second conveyance guide and configured to detect presence or absence of the recording medium, wherein the control unit determines that a jam occurs in the recording medium conveying path formed by the first conveyance guide and the second conveyance guide if the first jam sensor continues to detect the recording medium for a time equal to or longer than a threshold time and the second jam sensor does not detect the recording medium for the time equal to or longer than the threshold time.

12. The apparatus according to claim 6, further comprising an inserting roller in an inlet of the recording medium conveying path formed by the first conveyance guide and the second conveyance guide, wherein if the control unit determines that a jam occurs in the recording medium conveying path formed by the first conveyance guide and the second conveyance guide, the control unit stops the inserting roller, opens the second conveyance guide, and rotates the inserting roller to collect the recording medium.

13. A recording medium sorting method for an erasing apparatus including a control unit, the method comprising:

inserting a recording medium into a recording medium conveying path having curved surfaces formed by a first conveyance guide that forms the recording medium conveying path and a second conveyance guide set to be opposed to the first conveyance guide to be capable of opening and closing the recording medium conveying path; and opening the second conveyance guide to collect the recording medium that causes a jam in the recording medium conveying path.

14. The method according to claim 13, further comprising displacing, with a displacing device, the second conveyance guide in a direction opposite to the first conveyance guide to thereby open the recording medium conveying path.

15. The method according to claim 13, further comprising displacing, with a displacing device, the second conveyance guide to an outer side in a direction perpendicular to a recording medium conveying direction to thereby open the recording medium conveying path.

16. The method according to claim 15, further comprising collecting the recording medium along the second conveyance guide that tilts downward to an inner side of the recording medium conveying path.

17. The method according to claim 13, further comprising determining that a jam occurs in the recording medium conveying path formed by the first conveyance guide and the second conveyance guide if a first jam sensor provided in the recording medium conveying path formed by the first conveyance guide and the second conveyance guide and configured to detect presence or absence of the recording medium continues to detect the recording medium for a time equal to or longer than a threshold time and a second jam sensor provided downstream in a recording medium conveying direction of the recording medium conveying path formed by the first conveyance guide and the second conveyance guide and configured to detect presence or absence of the recording medium does not detect the recording medium for the time equal to or longer than the threshold time.

18. The method according to claim 13, further comprising, if the control unit determines that a jam occurs in the recording medium conveying path formed by the first conveyance guide and the second conveyance guide, stopping an inserting roller provided in an inlet of the recording medium conveying path formed by the first conveyance guide and the second conveyance guide, opening the second conveyance guide, and rotating the inserting roller to collect the recording medium.

19. The method according to claim 13, further comprising collecting, with the first conveyance guide and the second conveyance guide, the recording medium that causes a jam upstream in a recording medium conveying direction of a heating device configured to heat the recording medium to temperature equal to or higher than erasing temperature.

20. The method according to claim 17, further comprising:

if the control unit determines that a jam occurs in the recording medium conveying path formed by the first conveyance guide and the second conveyance guide, stopping an inserting roller provided in an inlet of the recording medium conveying path formed by the first conveyance guide and the second conveyance guide, opening the second conveyance guide, and rotating the inlet roller to collect the recording medium; and closing the second conveyance guide if the first jam sensor does not detect the recording medium for the time equal to or longer than the threshold time.

* * * * *